US009442437B2

(12) United States Patent
Honke et al.

(10) Patent No.: US 9,442,437 B2
(45) Date of Patent: Sep. 13, 2016

(54) IMAGE FORMING APPARATUS CHANGING TARGET TEMPERATURE OF HEATING MEMBER OR INTERVAL BETWEEN PRECEDING AND SUBSEQUENT RECORDING MATERIAL IN ACCORDANCE WITH RATIO OF TONER IMAGE AREA IN PREDETERMINED REGION TO PREDETERMINED REGION AREA

(71) Applicant: CANON KABUSHIKI KAISHA, Tokyo (JP)

(72) Inventors: Takashi Honke, Mishima (JP); Satoru Taniguchi, Mishima (JP); Jun Asami, Susono (JP); Hirohiko Aiba, Suntou-gun (JP); Masaki Hirose, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/669,517

(22) Filed: Mar. 26, 2015

(65) Prior Publication Data

US 2015/0277308 A1 Oct. 1, 2015

(30) Foreign Application Priority Data

Mar. 28, 2014 (JP) ..... 2014-069483

(51) Int. Cl.
*G03G 15/20* (2006.01)

(52) U.S. Cl.
CPC ..... *G03G 15/2039* (2013.01); *G03G 15/2078* (2013.01)

(58) Field of Classification Search
CPC ..... G03G 15/2039; G03G 15/2042; G03G 15/2046; G03G 15/2078; G03G 15/2082
USPC ..... 399/69, 328, 329, 334; 219/216
See application file for complete search history.

(56) References Cited

U.S. PATENT DOCUMENTS

| | | | |
|---|---|---|---|
| 6,842,592 B2 | 1/2005 | Kinoshita | |
| 7,389,079 B2 | 6/2008 | Narahara et al. | |
| 7,664,416 B2 * | 2/2010 | Watabe | 399/69 |
| 8,471,178 B2 | 6/2013 | Taniguchi et al. | |

(Continued)

FOREIGN PATENT DOCUMENTS

| | | |
|---|---|---|
| JP | 2002-311792 | 10/2002 |
| JP | 2004212904 A * | 7/2004 |

(Continued)

OTHER PUBLICATIONS

U.S. Appl. No. 14/635,116, dated Mar. 2, 2015.

(Continued)

*Primary Examiner* — Robert Beatty
(74) *Attorney, Agent, or Firm* — Fitzpatrick, Cella, Harper & Scinto

(57) ABSTRACT

An image forming apparatus that forms a toner image on a recording material includes: a temperature detection portion that detects the temperature of a heating member; a controller that controls the power to be supplied to the heating member so that the temperature detected by the temperature detection portion becomes the target temperature; and an acquisition portion that acquires information on a ratio of a region, where the toner image is formed, in a predetermined region located in an end portion of the recording material in a width direction thereof, and this controller changes the target temperature in accordance with the ratio.

19 Claims, 15 Drawing Sheets

(56) References Cited

U.S. PATENT DOCUMENTS

| | | | | |
|---|---|---|---|---|
| 8,600,259 | B2 | 12/2013 | Oi et al. | |
| 8,791,390 | B2 | 7/2014 | Taniguchi | |
| 8,983,325 | B2 | 3/2015 | Takeuchi | |
| 2002/0164175 | A1 | 11/2002 | Kinoshita | |
| 2004/0052542 | A1 | 3/2004 | Kinoshita | |
| 2006/0157464 | A1 | 7/2006 | Omata et al. | |
| 2008/0279577 | A1* | 11/2008 | Ito | 399/69 |
| 2013/0188978 | A1 | 7/2013 | Takeuchi | |
| 2013/0287423 | A1* | 10/2013 | Ohba | 399/69 |

FOREIGN PATENT DOCUMENTS

| | | | |
|---|---|---|---|
| JP | 2005331634 | A * | 12/2005 |
| JP | 2007147946 | A * | 6/2007 |
| JP | 2007-187816 | | 7/2007 |
| JP | 2009258448 | A * | 11/2009 |
| JP | 2013-174868 | | 9/2013 |
| JP | 2014-032236 | | 2/2014 |

OTHER PUBLICATIONS

U.S. Appl. No. 14/670,843, dated Mar. 27, 2015.

* cited by examiner

IMAGE FORMING APPARATUS CHANGING TARGET TEMPERATURE OF HEATING MEMBER OR INTERVAL BETWEEN PRECEDING AND SUBSEQUENT RECORDING MATERIAL IN ACCORDANCE WITH RATIO OF TONER IMAGE AREA IN PREDETERMINED REGION TO PREDETERMINED REGION AREA

BACKGROUND OF THE INVENTION

1. Field of the Invention

The present invention relates to an image forming apparatus, such as a copier and a printer, that forms an image on a recording material, using an electro-photographic technique.

2. Description of the Related Art

As a fixing apparatus included in an image forming apparatus using the electro-photographic technique, a fixing apparatus that uses a cylindrical film is known. This fixing apparatus has a film, a heater that contacts the inner surface of the film, and a pressure roller that constitute a nip portion, together with the heater via the film. The fixing apparatus heats the recording material bearing a toner image using the nip portion, so as to fix the toner image to the recording material.

A merit of this fixing apparatus is that the warm-up time of the apparatus is short, since the heat capacity of the members of the apparatus, including the heater and the film, is low. Because of this effect, the time from the apparatus receiving a print signal to completing the printing of the first sheet (FPOT: First Print Out Time) can be decreased. Power consumption can also be reduced since it is unnecessary to supply power to the heater while waiting for reception of the print signal.

On the other hand, it is known that in the fixing apparatus that uses this film, temperature in a non-paper passing portion easily rises, and an apparatus that can more effectively control this temperature rising in the non-paper passing portion is demanded.

To meet this demand, a configuration of blowing a breeze from a fan onto the fixing film of the non-paper passing portion and onto the pressure roller was proposed (Japanese Patent Application Laid-open No. 2007-187816).

With the above configuration, however, it is inevitable that the apparatus will become larger and cost will increase.

A countermeasure to the temperature rising in the non-paper passing portion is to reduce the caloric value of the heater in the non-paper passing portion. However, if the caloric value of the heater in the non-paper passing portion is reduced, the toner image in the end portion may not be sufficiently fixed, which generates a defective image.

SUMMARY OF THE INVENTION

According to a first preferred embodiment of the present invention, an image forming apparatus that forms a toner image on a recording material, comprising: an image forming unit that forms the toner image on the recording material; a fixing unit that fixes the toner image on the recording material while conveying the recording material bearing the toner image at a nip portion, the fixing unit including a heating member and a backup member forming the nip portion together with the heating member; a temperature detection portion that detects a temperature on the heating member; a controller that controls power to be supplied to the heating member so that the temperature detected by the temperature detection portion becomes a target temperature; and an acquisition portion that acquires information related to a ratio of a region, where the toner image is formed, to a predetermined region located in an end portion of the recording material in a width direction of the recording material, wherein the controller changes the target temperature in accordance with the ratio.

According to a second preferred embodiment of the present invention, an image forming apparatus that forms a toner image on a recording material, comprising: an image forming unit that forms the toner image on the recording material; a fixing unit that fixes the toner image on the recording material while conveying the recording material bearing the toner image at a nip portion, the fixing unit including a heating member and a backup member forming the nip portion together with the heating member; a temperature detection portion that detects a temperature on the heating member; a controller that controls power to be supplied to the heating member, so that the temperature detected by the temperature detection portion becomes a target temperature; and an acquisition portion that acquires information related to a ratio of a region, where the toner image is formed, to a predetermined region located in an end portion of the recording material in a width direction of the recording material, wherein the controller changes an interval between a preceeding recording material and a subsequent recording material in accordance with the ratio when continuous printing is performed.

Further features of the present invention will become apparent from the following description of exemplary embodiments (with reference to the attached drawings).

DESCRIPTION OF THE EMBODIMENTS

Embodiments of the present invention will be described using examples with reference to the drawings. Dimensions, materials and shapes of the components and relative configurations thereof according to the embodiments should be appropriately changed in accordance with the configuration and various conditions of the apparatus to which the invention is applied. In other words, the following embodiments are not intended to limit the scope of the present invention.

Example 1

Example 1 will be described below.

(General Configuration of Image Forming Apparatus)

Figure 1:
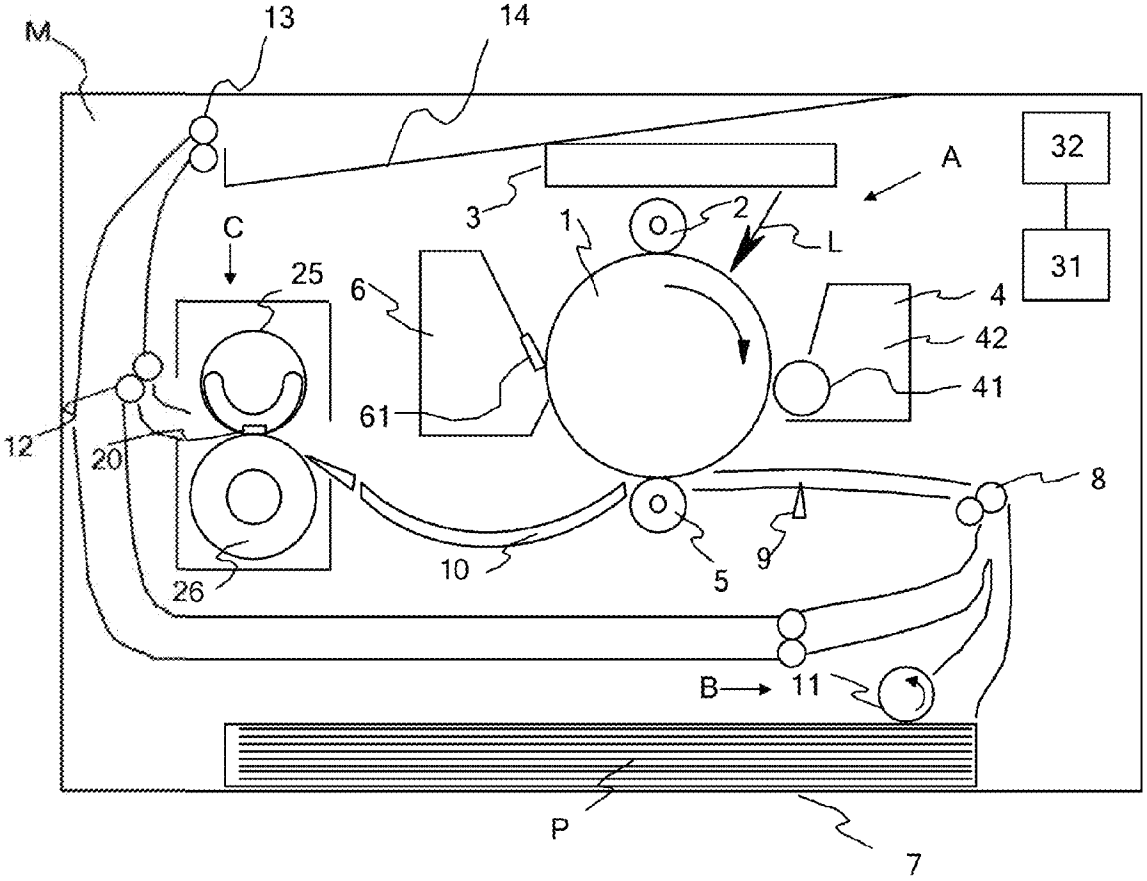
FIG. 1 is a cross-sectional view depicting a general configuration of an image forming apparatus according to Example 1.

FIG. 1 is a cross-sectional view depicting a general configuration of an image forming apparatus according to this example.

The image forming apparatus of this example includes an image forming unit A that forms a toner image (toner image, developer image) on a recording material P, and a recording material feeding unit B that feeds the recording material P to the image forming unit A, and a fixing unit (hereafter called "fixing apparatus") C that heats and fixes a toner image on the recording material P to the recording material P. Here the fixing apparatus C corresponds to an image heating unit.

The image forming unit A has a drum type electrophotographic photoreceptor (hereafter called "photosensitive drum") 1, which functions as an image bearing member. The photosensitive drum 1 is rotatably supported by an image forming apparatus main unit (hereafter called "apparatus main unit") M constituting the case of the image forming apparatus. A charging roller 2, a laser scanner 3, a developing assembly 4, a transfer roller 5 and a cleaning apparatus 6 are disposed around an outer peripheral surface of the photosensitive drum 1 along the rotating direction thereof.

The recording material feeding unit B has a feed-out roller 11. The feed-out roller 11 is rotated in the arrow direction at a predetermined timing by a conveying driving motor (not illustrated), so as to feed the recording material P, which is stored in a mounted cassette 7, out to a conveying path of the recording material. A conveying roller 8, a top sensor 9, an image forming unit A, a conveying guide 10, a fixing apparatus C, a conveying roller 12, an ejecting roller 13 and an ejection tray 14 are disposed sequentially in the apparatus main unit M along the conveying path of the recording material.

The image forming apparatus of this example includes a control unit (control unit 31 and video controller 32) which controls the image forming unit A, the recording material feeding unit B, the fixing apparatus C or the like. The control unit 31 is constituted by a CPU and such memories as ROM and RAM, and various programs required for printing (image forming) are stored in these memories. When a print signal is received from an external apparatus, such as a host computer, the video controller 32 sends the print signal to the control unit 31, and detects a printing rate of the received image. The method for calculating the printing rate by the video controller 32 will be described in detail later.

The control unit 31 executes a predetermined image forming control sequence based on the above mentioned print signal. Thereby the drum motor is driven and rotated, and the photosensitive drum 1 rotates in the arrow direction indicated in FIG. 1 at a predetermined peripheral velocity (process speed). At this time, the surface of the photosensitive drum 1 is uniformly charged at a predetermined potential in a same polarity as toner (minus plurality in this case) by a charging roller 2. On the charged surface of the photosensitive drum 1, the laser scanner 3 scans the laser beam L based on the image information, and exposes the surface of the photosensitive drum 1. By this exposure, charges on the exposed portion are removed, and a latent image (electrostatic latent image) is formed on the surface of the photosensitive drum 1.

The developing assembly 4 has a developing roller 41 and a toner container 42 that contains toner. Toner is rubbed by such a member as a blade and is charged to a predetermined polarity. In this example, toner charged to a minus polarity is used. This developing assembly 4 allows to adhere toner to the latent image on the surface of the photosensitive drum 1 using a potential difference, by applying a minus bias from a developing bias power supply (now illustrated) to the developing roller 41, and develops the latest image as a toner image. The toner image formed on the surface of the photosensitive drum 1 is transferred to the recording material P using the potential difference due to the transfer bias generated by applying the plus bias, which is the reverse polarity of the toner, to the transfer roller 5.

The conveying driving motor installed in the recording material feeding unit B is driven and rotated, and the feed-out roller 11 feeds the recording material P of the cassette 7 out to the conveying path. The recording material P fed out to the conveying path is conveyed by the conveying roller 8, passes through the top sensor 9, and is conveyed to a transfer nip portion between the surface of the photosensitive drum 1 and the transfer roller 5. At this time, the tip of the recording material P is detected by the top sensor 9. The recording material P, on which the toner image formed on the surface of the photosensitive drum 1 has been transferred, is conveyed to the fixing apparatus C along the conveying guide 10, and the toner image on the recording material P is heated and pressurized by the fixing apparatus C, and is fixed to the recording material P by heat. The recording material P, on which the toner image has been fixed by heating, is conveyed in the sequence of the conveying roller 12 and the ejecting roller 13, and is ejected to the ejection tray 14 on the upper surface of the apparatus main unit M. The untransferred toner remaining on the surface of the photosensitive drum 1, after the toner image is transferred to the recording material P, is removed by a cleaning blade 61 of the cleaning apparatus 6, and is stored inside the cleaning apparatus 6.

Printing is sequentially executed by repeating the above operation. The image forming apparatus of this example is a monochrome printer, and can print at a 60 sheets/minute print speed if the paper size is A4. A widest recording material size, out of the sizes of printable (feedable) recording materials P of the image forming apparatus of Example 1, is A4, and the maximum image forming region (printable region where images can be printed on the recording material) is an area of the A4 size, excluding a 2 mm masking region from the top, bottom, right and left edges.

(Configuration of Fixing Apparatus)

Figure 2:
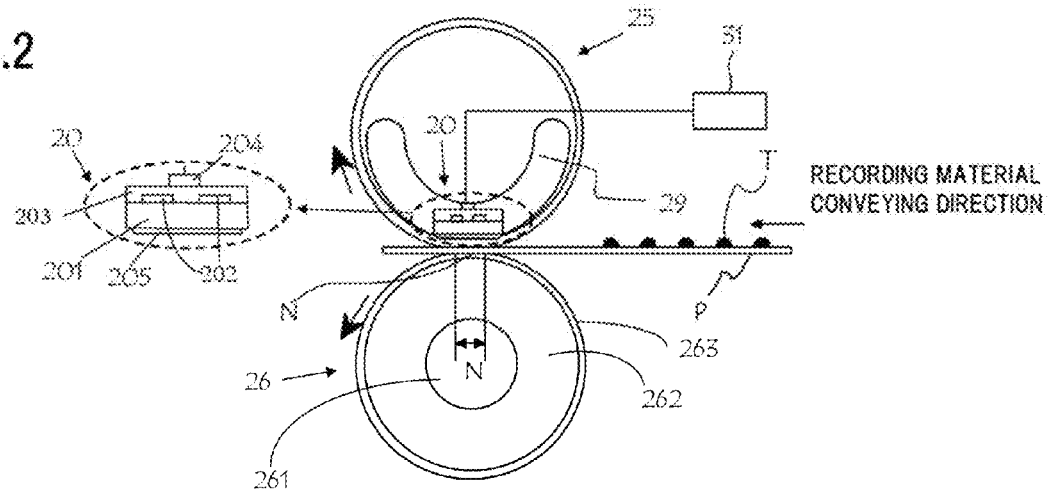
FIG. 2 is a cross-sectional view depicting a general configuration of a fixing apparatus of Example 1.

FIG. 2 is a cross-sectional view depicting a general configuration of the fixing-aperture C of this example.

The fixing apparatus C of this example includes a heater 20, a cylindrical fixing film 25 and a pressure roller 26. The fixing film 25 corresponds to the heating member (flexible sleeve). The pressure roller 26 corresponds to the pressure member (back-up member).

The recording material P on which a toner image has been formed is held between the fixing film 25 and the pressure roller 26, out of the fixing nip portion N formed between the heater 20 and the pressure roller 26 via the fixing film 25, while being conveyed and heated, whereby the toner image is fixed to the recording material P.

(Pressure Roller)

The pressure roller 26 has an elastic layer 262 on the outer periphery of a core portion 261 and has a surface layer 263 on the outer periphery of the elastic layer 262. The outer diameter of the pressure roller 26 is about 30 mm. For the core portion 261, a metal material, such as aluminum or iron, is used in a solid or hollow state. In this example, a solid aluminum is used for the core metal material. The elastic layer 262 is constituted by a heat resistant silicon rubber, and is made conductive by adding such electro-conductive material as carbon. In this example, the elastic layer 262 is constituted by silicon rubber where an appropriate amount of carbon has been added to adjust the volume resistivity to about $1\times10^5$ (Ω·cm), and the thickness thereof is 3 mm.

The surface layer 263 is a releasable tube constituted by such fluorine resin as PFA, PTFE or FEP, of which thickness is 10 to 80 μm. Here PTA stands for tetrafluoroethylene-perfluoro alkyl vinyl ether copolymer, PTFE stands for polytetrafluoroethylene (tetrafluoride), and FEP stands for tetrafluoroethylene/hexafluoropropylene copolymer (tetrafluoride, hexafluoride). In this example, the material of the surface layer 263 of the pressure roller 26 is a pure PFA tube, and the thickness thereof is 50 μm.

(Fixing Film)

Figure 3:
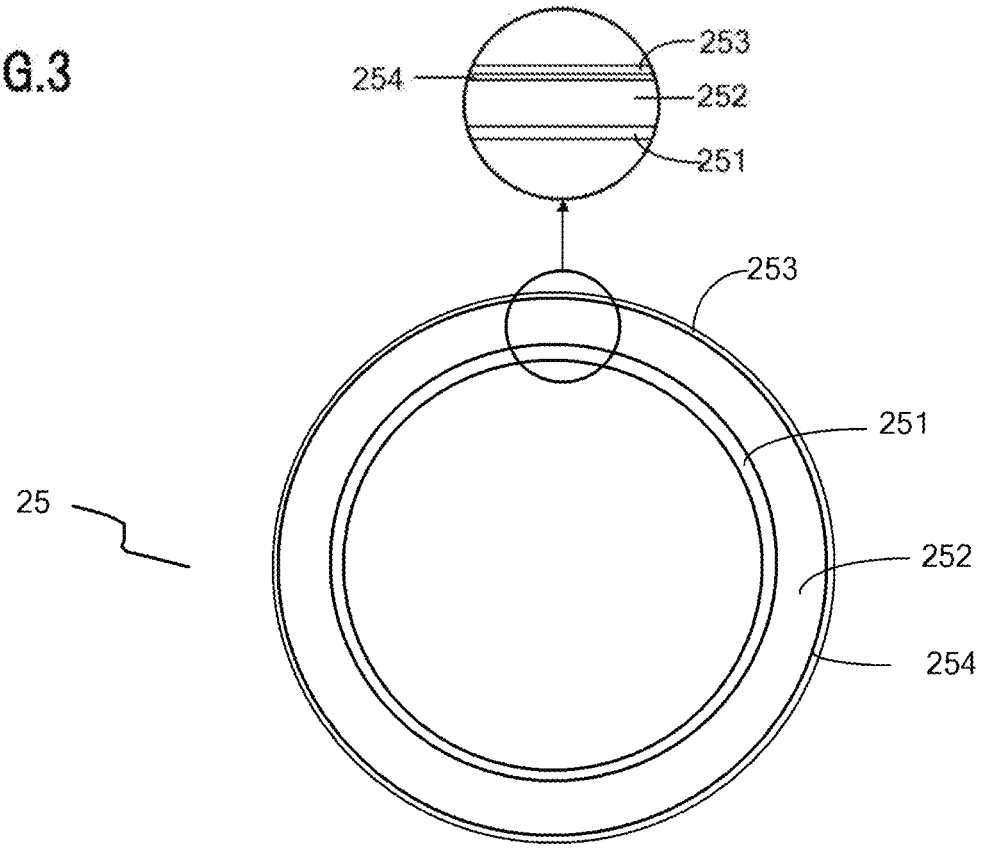
FIG. 3 is a cross-sectional view depicting a general configuration of a fixing film of Example 1.

FIG. 3 is a cross-sectional view depicting a general configuration of a fixing film 25 of this example. The fixing film 25 has a cylindrical shape of which diameter is 30 mm. The fixing film 25 is flexible and is loosely inserted into a semi-circular heater holder (film guide member) 29. The fixing film 25 has a multi-layered structure of, in order from the inside, a base layer 251, an elastic layer 252, a primer layer 254 and a surface layer 253.

A material used for the base layer 251 is thin metal, such as SUS and Ni, to improve the thermal conductivity and durability. Heat resistant resin material with a low heat capacity, such as polyimide, polyamide-imide, PEEK and PES, may be used. The thickness of the base layer 251 is preferably 15 μm or more, 50 μm or less, since it is necessary to minimize the heat capacity for quick starting and at the same time to satisfy the mechanical strength. The base layer 251 of this example is a cylindrical stainless (SUS) element tube of which thickness is 35 μm. The elastic layer 252 is constituted by a silicon rubber. This elastic layer 252 allows enwrapping the toner image and uniformly providing heat to the image, resulting in a uniform good quality image with a high gloss value. The elastic layer 252 constituted by silicon rubber alone has low thermal conductivity, hence a thermally conductive filler is added. The thermal conductivity of the elastic layer 252 is preferably about 1.2 W/mk.

In this example, 400 pts. wt. metallic silicon, which is a thermally conductive filler, is contained in the elastic layer 252 with respect to 100 pts. wt. dimethylpolysiloxane, which is a rubber material, so that the thermal conductivity of the elastic layer 252 becomes 1.2 W/mk. The thickness of the elastic layer 252 is 240 μm. The surface layer 253 is a release layer required to have a high abrasion resistance and a high release characteristic from toner. The material used for the surface layer 253 is fluororesin, such as PFA, PTFE and FEP mentioned above. To fluororesin, an ionic conductive material, such as an organic phosphorus compound and lithium salt, or an electronic conductive material, such as antimony pentoxide, titanium oxide, carbon black and carbon nano-fiber, is added to adjust the resistance value. The thickness of the surface layer 253 is preferably about 10 to 50 μm, and the tube may be covered or a coating material may be painted on the surface of the tube. The surface layer 253 of this example is a coating layer of pure PFA of which thickness is 15 μm. The primer layer 254 is an adhesion layer for adhering the surface layer 253 and the elastic layer 252, and is constituted by a fluororesin primer, such as low melting point fluororesin and fluorinated silicon. The primer layer may contain adhesive components, such as a silane coupling agent, in order to improve adhesion performance. In Example 1, an insulative fluororesin layer is used and the thickness thereof is 3 μm.

(Heater)

The heater 20 of this example has an elongated heat resistant heater substrate 201 constituted by aluminum nitride. A heating element pattern 202, which is an electric heating resistance layer (resistance heating element) which heats up by turning electricity ON, is formed on the rear surface of the heater substrate 201 (surface on the opposite side of the surface facing the fixing nip portion N) along the longitudinal direction of the heater substrate 201 by printing, for example (rear surface heating). Here the longitudinal direction of the heater substrate 201 is parallel with (same direction as) the width direction of the recording material P (rotation axis direction of the photosensitive drum 1), which is perpendicular to the conveying direction of the recording material P, and this direction is hereafter simply called "longitudinal direction".

The surface of the heating element pattern 202 is coated by a glass layer 203, which is a protective layer. A thermistor 204, which is a temperature detection unit (temperature detection member) that detects the temperature of the heater 20, is disposed on the surface of the glass layer 203. A sliding layer 205 is disposed on the surface of the heater substrate 201 (surface contacting the fixing nip portion N). In this example, the sliding layer 205 is a polyimide resin layer of which thickness is 6 μm.

This heater holder 29 functions not only as a support member that supports the heater 20, but also as a guide member that guides the rotation of the fixing film 25. A heat resistant resin, such as liquid crystal polymer, phenol resin, PPS and PEEK, is used as the material of the heater holder 29.

(Heating Element Pattern of Heater)

Figure 4:
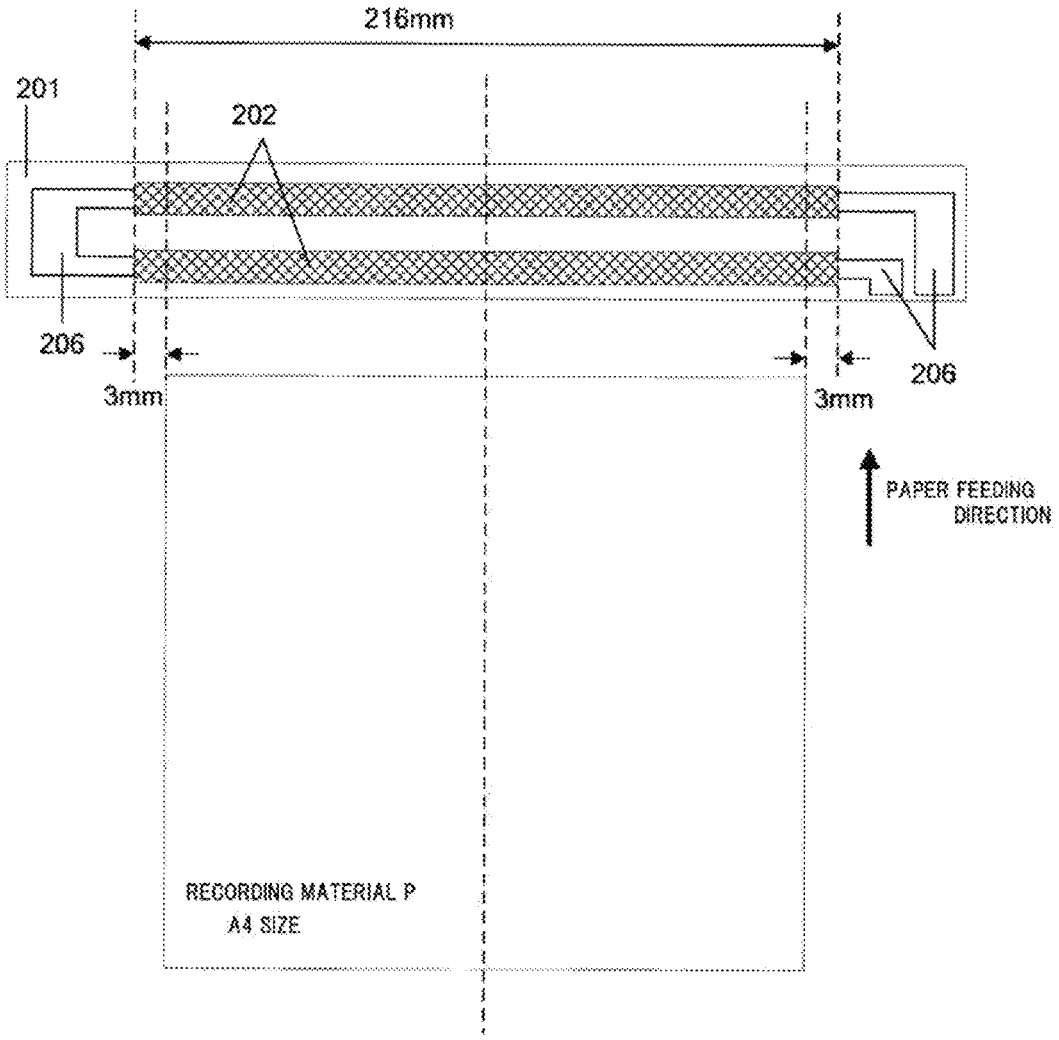
FIG. 4 is a schematic diagram depicting a configuration of a heating element pattern in the longitudinal direction of the heater of Example 1.

The heating element pattern 202 of the heater 20 of this example will be described with reference to FIG. 4. FIG. 4 is a schematic diagram depicting a configuration of the heating element pattern 202 of the heater 20 in the direction perpendicular to the conveying direction of the recording material P (hereafter called "longitudinal direction"). The heating element pattern 202 (shaded portion in FIG. 4) of the heater 20 is disposed on the heater substrate 201, and power is supplied (electric control) via an electrode 206 formed by a conductive material. The shape of the heating element pattern 202 is symmetric with respect to the center of the longitudinal direction, and the center of the heating element pattern 202 in the longitudinal direction is the same as the center of the recording material P in the longitudinal direction. The heating element pattern 202 is also symmetric in the conveying direction of the recording material.

The width of the heating element pattern 202 in the longitudinal direction extends from the A4 size (width: 210 mm), which is the maximum width size of paper that can be fed in this example. This extended portion of the heating element pattern 202 from the recording material P is called "heating element margin", and the width thereof is called "heating element margin width". In this example, the heating element margin width is set to 3 mm, that is, the width of the heating element pattern 202 in the longitudinal direction is set to 216 mm, from the perspective of temperature rising in the non-paper passing portion. Here the temperature rising in the non-paper passing portion is a temperature rising phenomenon of the fixing film 25 at the end portions in the longitudinal direction, where the temperature of the heater 20 and the fixing film 25 rise to extreme in the edge regions in the longitudinal direction where the recording material P does not pass, since the heat is not absorbed by the recording material P.

(Longitudinal Temperature Distribution of Surface Temperature of Fixing Film 25)

Figure 5:
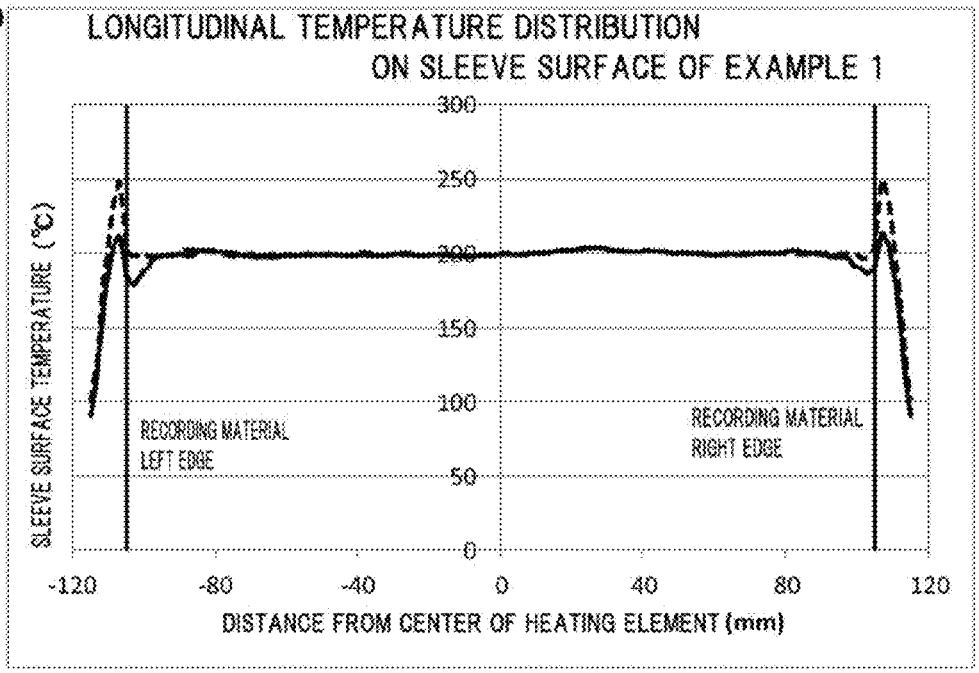
FIG. 5 is a graph depicting a longitudinal temperature distribution of the surface temperature of the fixing film of Example 1.

The longitudinal temperature distribution of the surface temperature of the fixing film 25 of this example will be described next. FIG. 5 shows the surface temperature distribution of the fixing film 25 of this example in the longitudinal direction. The abscissa indicates the distance (mm) from the center of the heating element (center of the heating element pattern 202 in the longitudinal direction), when the center of the heating element pattern 202 in the longitudinal direction is zero, and the ordinate indicates the surface temperature of the fixing film 25.

Power to be supplied to the heater 20 is controlled so that the detected temperature by the thermistor 204 becomes 230° C., which is the reference control temperature (target temperature), the solid line indicates a temperature profile when 10 sheets of A4 sized recording material P were fed continuously in this state, and the dotted line indicates the temperature profile when 500 sheets of A4 sized recording material P were fed continuously. The surface temperature of the fixing film 25 when 500 sheets were printed continuously is saturated, and the surface temperature of the film did not change even if the number of printed sheets (number of sheets printed or fed) is increased.

As FIG. 5 shows, temperature rises in the non-paper passing portions outside the paper passing region of the recording material P in both the solid line (after printing 10 sheets) and the dotted line (after printing 500 sheets). The temperature rising in the non-paper passing portions is more conspicuous in the heating element margin region because the heat of the heating element pattern 202 cannot be transferred to the recording material P, and the temperature increases as the number of continuously printed sheets increases.

In Example 1, it is important to keep the temperature of the fixing film 25 to 250° C. or less, even in the dotted line profile (after continuously printing 500 sheets). This is because the elastic layer 252 of the fixing film 25 deteriorates by the heat if the temperature of the fixing film 25 exceeds 250° C. Therefore the heating element margin width must be set to 3 mm or less, so that the temperature in the non-paper passing portions does not exceed 250° C., even after continuously printing 500 sheets.

Figure 6:
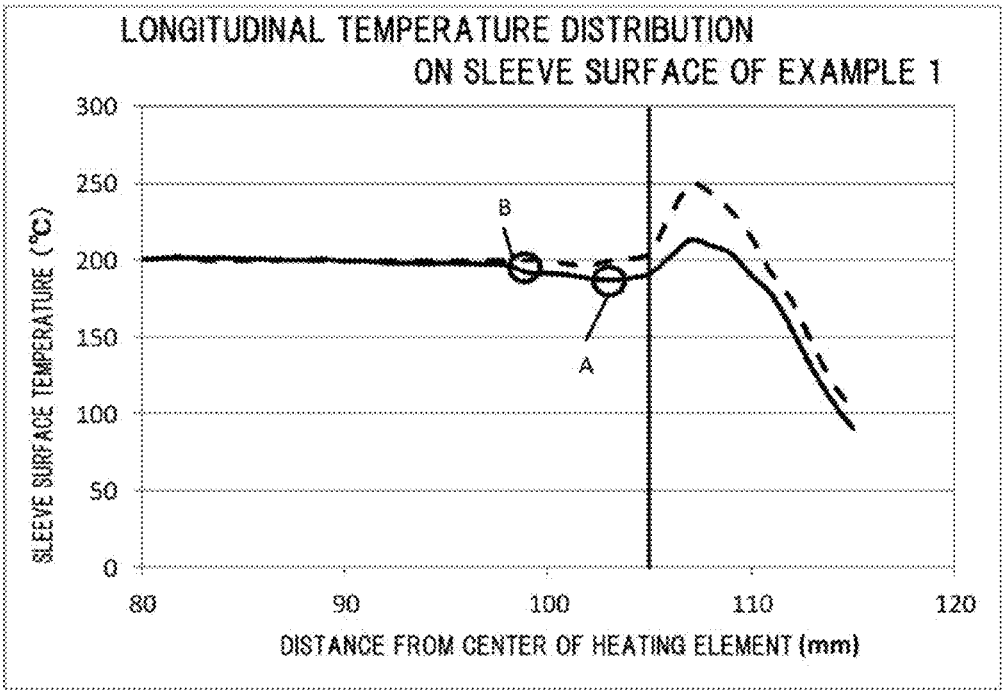
FIG. 6 is an enlarged view of the fixing film surface temperature in the recording material end portion shown in FIG. 5.

However if the temperature rising in the non-paper passing portions is decreased, the surface temperature of the portions of the fixing film 25 that correspond (face) to both edge positions of the recording material P in the longitudinal direction becomes low in the initial stage of continuous printing (printing of less than 50 sheets). FIG. 6 is an enlarged view of the surface temperature of the fixing film 25 in the edge regions of the recording material shown in FIG. 5. In this example, the end portions and the center portion (center part, center in the longitudinal direction) of the recording material P, the heater 20 and the fixing film 25 may simply be called "end portions" and "center portion".

In FIG. 6, the position of the right edge, when the A4 sized recording material P passes, is shown, where A indicates the position at about 2 mm and B indicates the position at about 6 mm from the right edge of the A4 sized sheet. Further, just like FIG. 5, the solid line indicates the profile after continuously printing 10 sheets, and the dotted line indicates the profile after continuously printing 500 sheets.

As shown in FIG. 6, in the profile of the solid line (after printing 10 pages), the surface temperature of the fixing film 25 in the regions which is about 2 to 6 mm from the edges of the print material P is lower than the temperature near the center. For example, the temperature in the position of B in FIG. 6 is about 192° C. and the temperature in the position of A in FIG. 6 is about 187° C., which are 9 to 14° C. lower than the temperature in the center portion, which is about 201° C.

The surface temperature of the fixing film 25 becomes low at the edges of the recording material P in the initial period of continuous printing because in the edge regions, heat is easily conducted through the heater 20, the fixing film 25 and the pressure roller 26, and is released from the edges of these members. This tendency is even more conspicuous in a fixing apparatus in which the calorific value is kept low at the edges.

(Printing Rate and Fixing Performance)

Because of the attempt to reduce the temperature rising in the non-paper passing portions, the surface temperature of the fixing film 25 corresponding to (facing) the end portions of the recording material P (regions that are 2 to 6 mm from the edges of the recording material in this example), in the initial period of continuous printing, inevitable becomes lower than the center portion. This state, where the surface temperature of the fixing film 25 (in the fixing nip portion N) in portions facing the end portions of the recording material P have become lower than the center portion, is hereafter referred to as "end portion temperature drop". If the surface temperature of the fixing film 25 becomes low, sufficient heat cannot be supplied to the toner, therefore a drop in fixing performance (fixing ability) becomes a concern.

It is known that the fixing performance is also greatly influenced by the printing rate (printing rate of the toner T) on the recording material P. Here the cover rate indicates a ratio of the region covered by toner (region where the toner image is formed) with respect to a predetermined region of the recording material P. Generally as the printing rate of the toner T is greater, a higher calorific value is required for fixing the toner image.

The influence of the printing rate of the toner becomes more conspicuous in a vertically long toner image (belt-shaped that is long in the recording material conveying direction), that is, an image pattern of which printing rate is high in a specific region in the longitudinal direction. The reason for this follows.

If the printing rate is high in a local region in the longitudinal direction, the toner absorbs the heat from the fixing film 25 in the local region in the longitudinal direction, and the surface temperature drops. If the surface temperature of the fixing film 25 drops, heat is supplied by the heater 20 via the base layer 251 and the elastic layer 252, or by a heat wraparound from the neighboring regions of the surface layer 253. However in the case when the printing rate in the local region in the longitudinal direction is high throughout the recording material conveying direction, as in the case of the above mentioned vertically long image, the supply of heat from the heater 20 and the peripheral regions cannot catchup with the heat absorbed by the toner, and the surface temperature of the film drops further. As a result, a fixing failure is generated due to insufficient heat. This tendency may become more conspicuous in a case of an image forming apparatus that can perform high-speed printing, which becomes a concern.

In the fixing apparatus C having the above configuration, the surface temperature of the fixing film 25 is high in the center portion, where even a pattern of which printing rate is high in the local region in the longitudinal direction (e.g. vertically long pattern) can be fixed. However in the regions 2 to 6 mm from the edges of the recording material P, the surface temperature of the fixing film 25 is low, and a fixing failure may be generated in the vertically long image. In the case of the above configuration, a fixing failure may be generated if a printing rate of the image exceeds 15%.

On the other hand, even in the regions 2 to 6 mm from the edges, the fixing performance can be satisfied if the printing rate of the image pattern is low (e.g. character pattern), since sufficient heat is provided. In the above mentioned configuration, the fixing failure is not generated if the printing rate of the image is lower than 15%.

A possible method for solving this problem is to evenly increase the power to be supplied to the heater 20, regardless the image pattern, so as to increase the surface temperature of the fixing film 25. Actually if the heater is controlled in the above configuration so that the target temperature of the heater 20 becomes 240° C. (a 10° C. increase), a fixing failure is not generated even in the vertically long image. However, if this countermeasure of setting the target control temperature (fixation temperature) to 240° C. for the entire apparatus life is adopted, the surface temperature of the fixing film 25 becomes high through the entire apparatus life of the fixing unit. As a result, the surface layer 253 of the fixing film 25 deteriorates by abrasion, the release characteristic of the surface layer 253 for the toner T is lost, and a fixing failure is generated before apparatus life-time durability is implemented, which becomes a concern.

Therefore in this example, implementing increased "durability" is attempted after improving the "fixing performance when a high printing rate image is printed on the end portions".

Characteristic control of this example which implements both "fixing performance when a high printing rate image is printed on the end portions" and "durability" will be described later.

(Fixing Control)

In the control of this example, the temperature rising state of the end portions of the fixing film 25 (fixing nip portion N) is estimated (predicted, forecasted), and if it is estimated that the end portion temperature drop is considerable, the fixation temperature is changed in accordance with the printing rate information of the end portions. The printing rate of the end portions may be called "end portion printing rate" in the following description.

Figure 7:
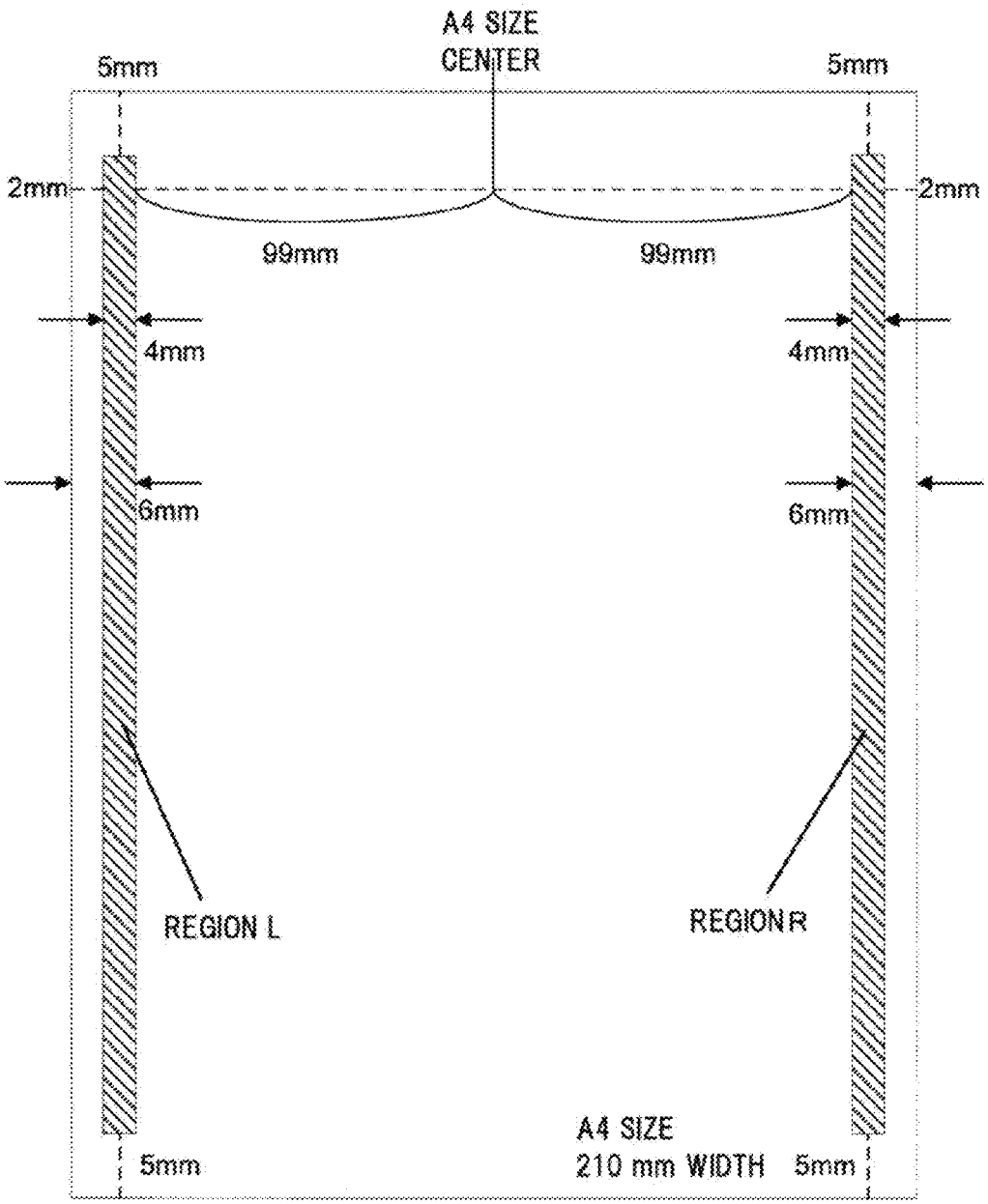
FIG. 7 is a diagram depicting regions to detect the printing rate information of the Example 1.
Figure 8:
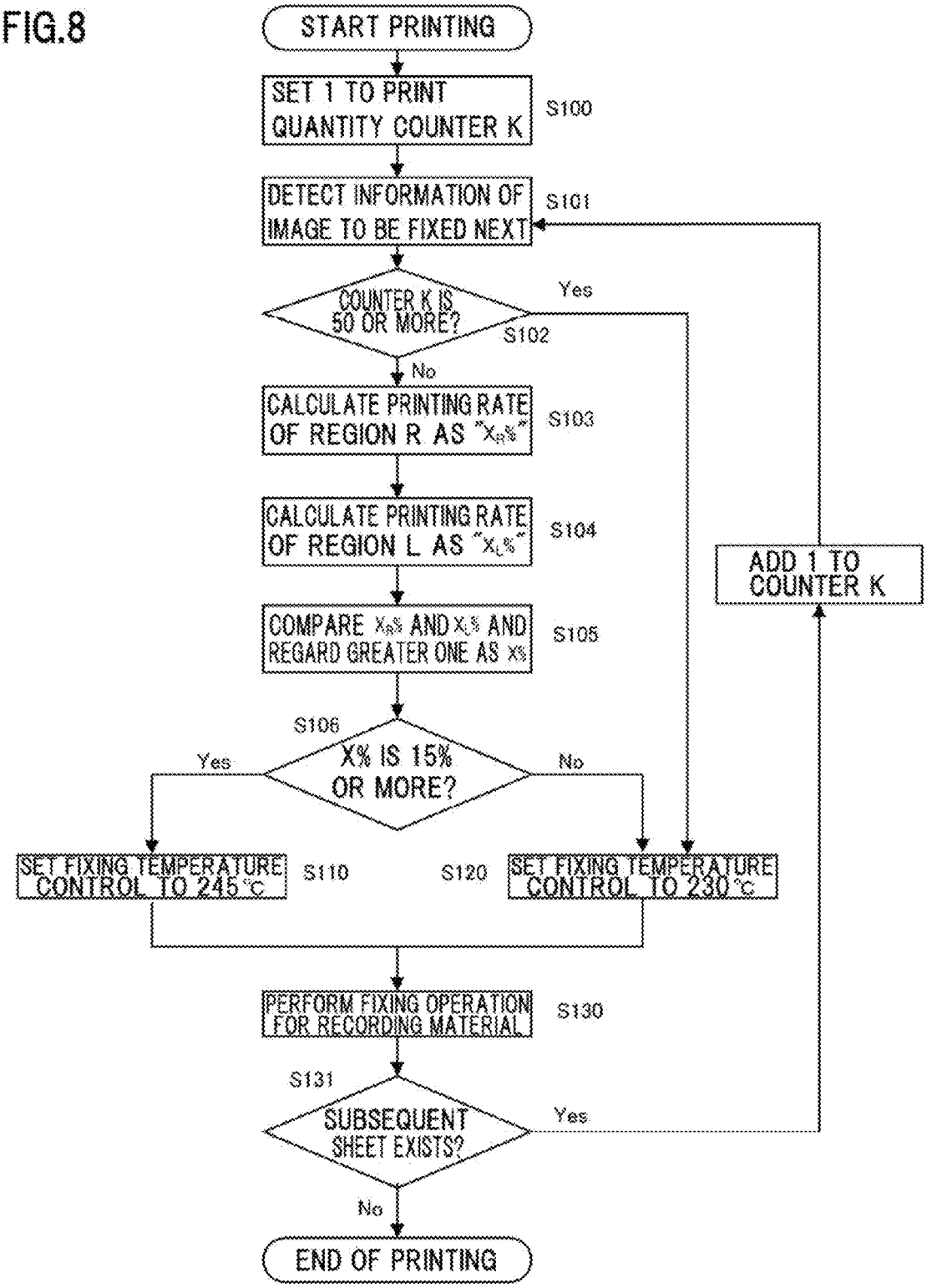
FIG. 8 is a flow chart depicting the sequence of the fixing control of Example 1.

FIG. 7 is a diagram depicting predetermined regions (detected regions) to acquire (detect) information on the printing rate, out of the end portions of the recording material P. FIG. 8 is a flow chart depicting a sequence for determining the fixation temperature (target temperature) (sequence diagram depicting the fixing control) according to this example.

With reference to FIG. 7, first the detection regions to detect information on the printing rate according to this example will be described. This example uses information on the printing rate of a vertically long region, which is 2 to 6 mm from the right edge of the A4-sized recording material P (shaded portion in FIG. 7: region R), and a vertically long region which is 2 to 6 mm from the left edge of the A4-sized recording material P (region L). It is set such that the regions R and L include the above mentioned edges of the maximum image forming region. The positions of the regions R and L are located 2 mm away from the right and left edges (both edges) of the A4-sized recording material P respectively because 2 mm from each edge is a masking region (non-printing region) in the image forming apparatus of this example, as mentioned above. The inner sides of the regions R and L are 6 mm away from the respective edges of the recording material P because the end portion temperature drop may be generated in the regions 6 mm from the right and left edges in this example. The regions R and L are 5 mm away from both edges (front and rear edges) in the recording material P conveying direction respectively.

To estimate the temperature rising state of the end portions of the fixing film 25, information on the temperature of the fixing film 25 in the fixing nip portion N is used, and for this information, a number of printed sheets, which is counted by the counter K, is used in this example, as mentioned later. Here the control unit 31 corresponds to the temperature information acquisition unit that acquires information on the temperature of the fixing film 25 in the fixing nip portion N. The counter K corresponds to the count unit that counts a number of printed sheets when a plurality of sheets of recording material is continuously printed.

The information on the temperature of the fixing film 25 in the fixing nip portion N is not limited to the number of sheets, as mentioned above. This information may be a temperature of the heater 20 detected by the temperature detection unit, or a temperature of the fixing apparatus C, or any other information that allows to estimate the temperature rising state of the end portions of the fixing film 25.

Now, with reference to FIG. 8, the sequence to determine the fixation temperature, which is executed by the control unit 31, will be described. In this example, this sequence is executed for all print jobs.

As shown in FIG. 8, 1 is set to the counter K, which counts a number of continuously printed sheets (S100), then information on the image is detected (information on the printing rate is acquired) (S101). Then in order to estimate the temperature rising state of the end portions of the fixing apparatus C, the value of the counter K, which is a number of printed sheets, is read (S102). Here the counter K counts a number of sheets continuously fed during one paper feeding job, and it is estimated that the temperature of the end portions has risen more as the value of the counter K is greater. If the value of the counter K is 50 or more, it is estimated that the end portion temperature drop is small, hence the target control temperature is set to 230° C. and the fixing operation is performed (S120).

If the value of the counter K is less than 50 (less than the threshold), on the other hand, it is estimated that the end portion temperature drop is large, and control to change the fixation temperature according to the information on the printing rate is started. Then according to the image information detected in (S101), the printing rate of the region R shown in FIG. 7 is calculated, and the result is regarded as $X_R$% (S103). In the same manner, the printing rate of the region L is calculated, and the result is regarded as $X_L$% (S104). Then the acquired $X_R$% and $X_L$% are compared, and the greater one is regarded as "X %", and is used as information on the printing rate of the subsequent sheet (S105). In this example, the printing rate is detected using the video controller 32, and information on the printing rate is determined based on the acquired result. The following calculation formula is used to calculate the printing rate at this time. Here the control unit 31 that acquires the printing rate detected by the video controller 32 corresponds to the printing rate acquisition unit.

$$X_R, X_L = \frac{\text{Number of pixels of image to be printed (out of region } R \text{ or region } L)}{\text{Total number of pixels of (region } R \text{ or region } L)} \quad \text{[Math. 1]}$$

Then the end portion printing rate X % is compared with the 15% threshold rate (S106). If X % is 15% or more (threshold or more), the target control temperature is set to 240° C. (S110). If X % is less than 15%, the target control temperature is set to 230° C. (S120). Then the fixing operation is performed for the recording material P at the target control temperature which was set in S110 or S120 (S130). If the target control temperature is set to 240° C. here, electricity control is performed for the heating element pattern 202 such that the calorific value of the heating element pattern 202 becomes higher than the case when the target control temperature is set to 230° C.

Then the operation from S101 to S130 is repeated as long as an unprocessed print job remains (S131).

As mentioned above, in this example, a fixing failure is not generated even if the target control temperature of the heater 20 is 230° C., only if the end portion printing rate is less than 15%. On the other hand, even if the end portion printing rate is 15% or more, a fixing failure is not generated if the target control temperature is set to 240° C.

(Comparison with Image Forming Apparatus of Comparative Example)

Comparative experiments were conducted using image forming apparatuses of comparative examples, in order to explain a functional effect of the image forming apparatus of this example. Table 1 shows the target control temperature of the heater 20 during the feed in Example 1 and in Comparative Examples 1 and 2.

The image forming apparatus of this example is configured such that the control to change the target control temperature of the heater 20 can be executed based on the information on the printing rate, according to the sequence shown in FIG. 8. In concrete terms, if the end portion printing rate is less than 15%, the target control temperature of the heater is set to 230° C., and if it is 15% or more, the target control temperature is set to 240° C. In the case of the image forming apparatuses of the Comparative Examples 1 and 2, on the other hand, the target control temperature of the heater is the same, regardless the information on the printing rate, that is, 230° C. in the case of Comparative Example 1, and 240° C. in the case of Comparative Example 2. The other conditions are the same as this example, hence redundant description thereof is omitted.

TABLE 1

Comparison Result of Example 1 and Comparative Examples 1 to 3

| | Target control temperature | |
|---|---|---|
| | Printing rate of end portions less than 15% | Printing rate of end portions 15% or more |
| Example 1 | 230° C. | 240° C. |
| Comparison Example 1 | Regardless printing rate information 230° C. | |
| Comparison Example 2 | Regardless printing rate information 240° C. | |

The conditions used for this verification will be described in detail. The printing speed of the image forming apparatuses used for this verification is 60 sheets/minute (A4 size), the conveying speed of the recording material P is 350 mm/sec, and the life duration of the fixing apparatuses C is 300,000 sheets (300 k sheets). The fixing apparatus C presses the fixing film 25 at 186 N (about 19 kgf) using the pressure roller 23, and the nip width (width in the recording material conveying direction) thereof is about 9 mm. The environment under which these tests were conducted is a 23° C. temperature and a 50% humidity, and the evaluation paper is Oce Red Label (A4 size, 80 g/cm$^2$). The life durability test and evaluation were performed for 300,000 sheets under these conditions using the image forming apparatuses of Example 1, and Comparative Examples 1 and 2. For the evaluation, the fixing performance was evaluated for groups of 100,000 sheets before starting durability test and after starting the durability test, until reaching the life duration (300,000 sheets) of the fixing apparatus. To evaluate the fixing performance, recording materials having an image pattern with a low printing rate (5%) and recording materials having a high printing rate of end portions (95%) were fed, and the fixing performance was evaluated respectively. The images that were fed during the durability test were selected and set over a wide range, from an image pattern at a low printing rate (about 1%) to a high printing rate of the edge patterns (about 100%), anticipating image patterns that a user may actually use. In the durability test, sheets were fed such that the ratio of the images of which printing rate is less than 15%, which the user uses relatively often, is 90% of all the sheets, and the ratio of the image of which printing rate is 15% or more, which the user uses less frequently, is 10% of all the sheets. Table 2 shows the result of this verification. Here symbols to indicate the fixing performance in Table 2 will be described. 0 in Table 2 indicates "Good" without the generation of a fixing failure. X in Table 2 indicates that a fixing failure was generated, which means that a functional problem may occur.

TABLE 2

| End portion | Initial | | 100,000 Sheets | | 200,000 Sheets | | 300,000 Sheets | |
|---|---|---|---|---|---|---|---|---|
| printing rate | 5% | 95% | 5% | 95% | 5% | 95% | 5% | 95% |
| Example 1 | ○ | ○ | ○ | ○ | ○ | ○ | ○ | ○ |
| Comparative Example 1 | ○ | X | ○ | X | ○ | X | ○ | X |
| Comparative Example 2 | ○ | ○ | ○ | ○ | X | X | ←Stop | |

According to the results indicated in Table 2, if the target control temperature of the heater is fixed to 230° C. regardless the end portion printing rate as in the case of Comparative Example 1, the fixing failure was generated even in the initial phase in an image of which end portion printing rate is 95%, which means that a functional problem may occur. If the target control temperature of the heater is fixed to 240° C. regardless the end portion printing rate, as in the case of Comparative Example 2, the fixing failure was not generated in the durability test from the initial phase to feeding 100,000 sheets. However an obvious fixing failure was generated in the fixing performance devaluation after 200,000 sheets were fed, hence feeding sheets during the durability test was stopped. This fixing failure was observed in both images of which end portion printing rates are 5% and 95%. At this time, the surface layer 253 of the fixing film 25 was wears out due to continuous feeding at high temperature, and the releasability of the toner T was lost. This "wears out" condition occurs during the durability test where 200,000 sheets were fed at a target control temperature of 240° C.

On the other hand, in the case of the image forming apparatus of this example, good images were acquired for both images of which end portion printing rate is 5% and 95%, throughout the life durability test (throughout long term usage) without generating fixing failures. The reasons for this follow.

First a fixing failure was not generated in the images of which end portion printing rate is 95%, as in the case of Comparative Example 1, because the target control temperature is increased to 240° C. if the end portion printing rate is 15% or more, as described above. And the surface layer of the fixing film 25 did not wear out during the durability test as in the case of Comparative Example 2 because the ratio of printing, for which the target control temperature is set to high, 240° C., is minimized (10% in this verification).

As described above, according to this example, the functional effect, which cannot be acquired in Comparative Example 1 and 2, can be acquired. In other words, by performing the above sequence, good fixing performance can be implemented even if an image, of which printing rate of the end portion regions of the recording material is high, is printed while suppressing temperature rising in the non-paper passing portions. Moreover, even in the image forming apparatus of which temperature rising in the non-paper passing portion is conspicuous, both the fixing performance and the durability can be implemented for the patterns of which end portion printing is high. As a result, a better image can be acquired without generating a fixing failure during the life duration test.

Here an example of feedback control of the target control temperature of the heater 20 in accordance with the printing rate of the end portions was shown, but the present invention is not limited to this, and feedback control may be performed by another fixing control. For example, a number of printed sheets per unit time, power supplied to the heater 20 or the like can be used. The fixing performance can be improved by decreasing a number of printed sheets per unit time (number of sheets of recording material that are held and conveyed by the fixing nip portion N), or increasing the power supplied to the heater 20. To decrease the number of printed sheets per unit time, the timing to feed the recording material P may be delayed (interval between the preceeding recording material and the subsequent recording material is increased), or the rotation speed of the fixing film 25 or the pressure roller 26 may be decreased.

The technical concept of this example can be applied even when the target temperature is controlled by a composing member other than the heater 20 constituting the fixing apparatus C, such as the fixing film 25.

Further, a number of printed sheets per unit time may also be controlled in addition to performing the feedback control of fixing according to the printing rate of the end portions. Many of these controls as possible can be combined.

In this example, the regions R and L, which are regions to detect the printing rate of the end portions, are virtually long regions which are 2 to 6 mm from each edge, but these regions may be changed according to the degree of the end portion temperature drop. The regions may also be changed corresponding to the size of the recording material, and this will be described in Example 4. In this case as well, it is more effective that the regions R and L include the respective edges of the maximum image forming region, where the end portion temperature drop is most conspicuous. In this example, the printing rates of both end portions are detected, and the greater one of the printing rates is used (selected), but this fixing control may be performed by detecting only one side of the end portions. Further, in this example, the ON/OFF of all the pixels of the regions R and L are detected in order to detect the printing rate, but a number of detection points may be optimized according to the processing capability of the video controller 32. For example, in the case of a video control 32 of which processing capability is low, the printing rate may be calculated in a part of the detection points randomly selected within the regions R and L.

Furthermore, in this example, the film heating type fixing apparatus C was described as the image heating unit in this example, but the present invention is not limited to this. In other words, in the case of an apparatus having a problem of temperature rising in the non-paper passing portion, the present invention can be applied ideally when an image, of which end portion printing rate is high, is printed while suppressing the temperature rising in the non-paper passing portion. The image heating unit is not limited to the above mentioned unit that functions as the fixing apparatus, but may be applied to an apparatus that provides gloss to the toner image fixed onto the sheet. In this example, a monochrome printer was described as an example of the image forming apparatus, but the present invention is not limited to this. In other words, the technical concept of this example can be applied ideally to any image forming apparatus that includes an image heating unit.

Example 2

Example 2 will now be described. The differences of Example 2 from Example 1 are only in the configuration of the fixing apparatus and the sequence of the fixing control using the printing rate. In this example, only the composing elements that differ from Example 1 will be described, and description of the same composing elements as Example 1 is omitted.

Figure 9:
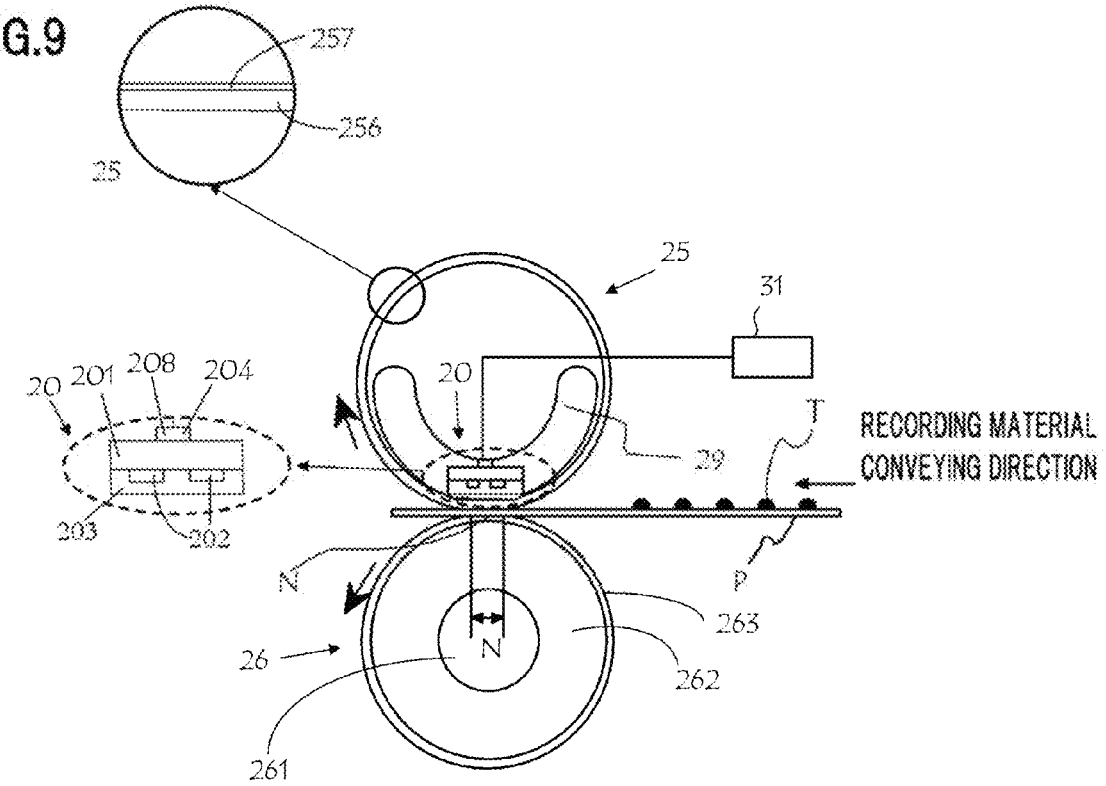
FIG. 9 is a cross-sectional view depicting a general configuration of a fixing apparatus of Example 2.

FIG. 9 is a cross-sectional view depicting a general configuration of a fixing apparatus C of this example. The configuration of this example is suitable for an image forming apparatus of which the thermal conductivity of the heater substrate 201 in the longitudinal direction is low, and temperature rising in the non-paper passing portions is conspicuous.

(Configuration of Fixing Apparatus)

In the fixing apparatus C of this example, composing elements that differ from Example 1 are: a heater 20 and a fixing film 25. The configuration of the fixing apparatus C of this example will be described with reference to FIG. 9.

The heater 20 of this example has a heat resistant heater substrate 201 constituted by alumina. A heating element pattern 202 is formed on the heater substrate 201, and a glass layer 203 is formed thereon. The glass layer 203 is disposed on a surface on which the fixing nip portion N slides. In this example, alumina is used as a material of the heater substrate 201, however it is known that the thermal conductivity is lower than the aluminum nitride of Example 1. To compensate for this characteristic, this example uses a configuration where the heating element pattern 202 is disposed on the fixing nip portion N side (sliding surface side, the side facing the fixing nip portion N) of the heater substrate 201 (surface heating). Further, according to this example, two means of temperature detection (temperature detection units), that is, a thermistor 204 and an end portion thermistor 208, are contacted with the heater substrate 201 in order to detect the temperature of the heater 20. While the thermistor 204 is installed at the approximate center of the heater 20 in the longitudinal direction, the end portion thermistor 208 is installed at the end portion in the longitudinal direction, that is, a position 103 mm from the center of the heating element (about 2 mm from the edge of the recording material).

Further, as the enlarged view in the solid line circle in FIG. 9 shows, the fixing film of this example is constituted by two layers. A base layer 256 is constituted by polyimide resin, with a thickness thereof of 70 μm. A surface layer 257 is formed on the surface of the base layer 256. The surface layer 257 is constituted by PFA, with a thickness thereof of 15 μm.

A difference of the fixing film 25 of this example from Example 1 is that the elastic layer is missing. Since the fixing film 25 of this example does not have the elastic layer, the heat capacity is smaller accordingly.

The fixing apparatus C of this example has the above mentioned features in terms of configuration. As a result, compared with Example 1, the temperature rising in the non-paper passing portion becomes more conspicuous. Hence in the heating element pattern 202 of the heater 20 of this example, the resistance value is lowered in the region extending from the end portion of the recording material P (heating element margin region), so as to keep the calorific value low. As a result, the temperature rising in the non-paper passing portion is kept at 250° C. or less, which is equivalent to Example 1.

Figure 10:
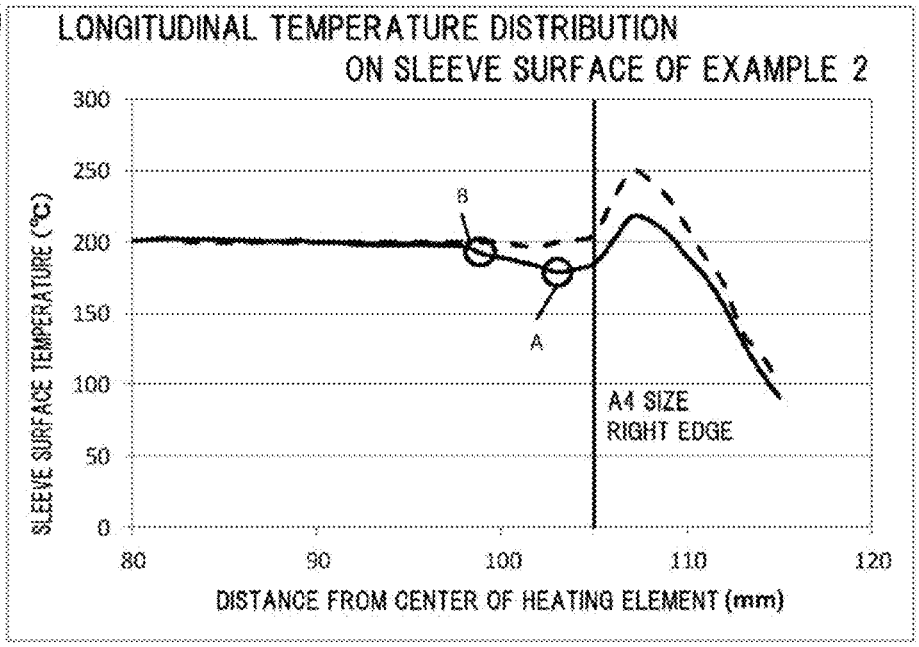
FIG. 10 is a graph depicting a longitudinal temperature distribution of the surface temperature of the fixing film of Embodiment 2.

On the other hand, the end portion temperature drop in the end portion region of the recording material P may be more conspicuous, which becomes a concern. FIG. 10 is an enlarged view of the recording material end portion region extracted from the longitudinal surface temperature distribution of the fixing film 25 of this example. Just like Example 1, FIG. 10 indicates a position of the right edge of the A4 sized recording material P and positions that are 2 mm inward (A in FIG. 10) and 6 mm inward (B in FIG. 10) therefrom. The surface temperature of the fixing film 25 is about 179° C. at position A, and about 192° C. at position B, which are lower than Example 1 respectively. Therefore there is concern about an image-apparatus forming apparatus having this configuration in that a fixing failure in the edge positions is more easily generated than Example 1.

Therefore in this example, the information on the printing rate is sub-divided and fed back to the fixing control.

(Fixing Control)

Figure 11:
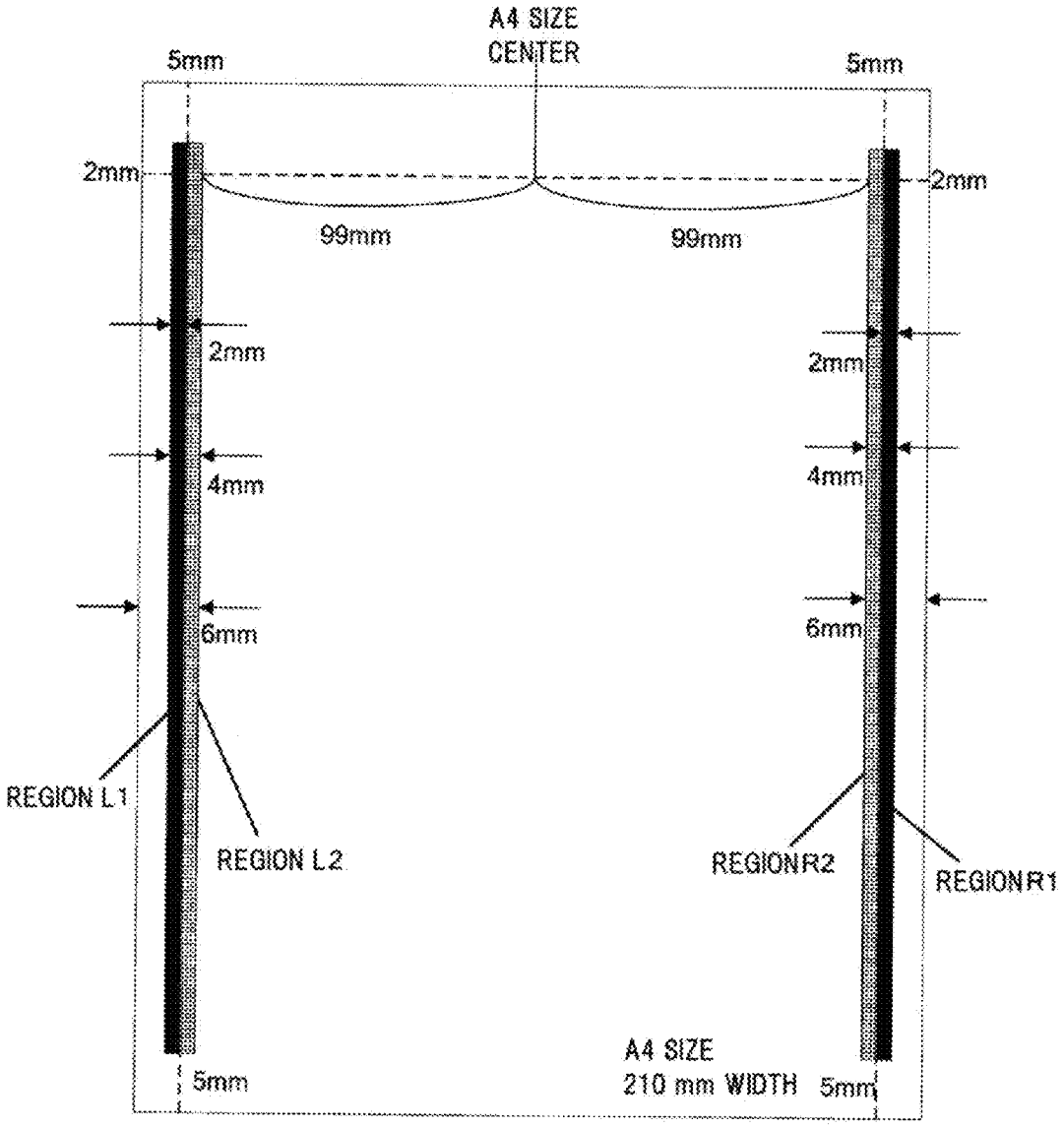
FIG. 11 is a diagram depicting regions to detect the printing rate information of Example 2.
Figure 12:
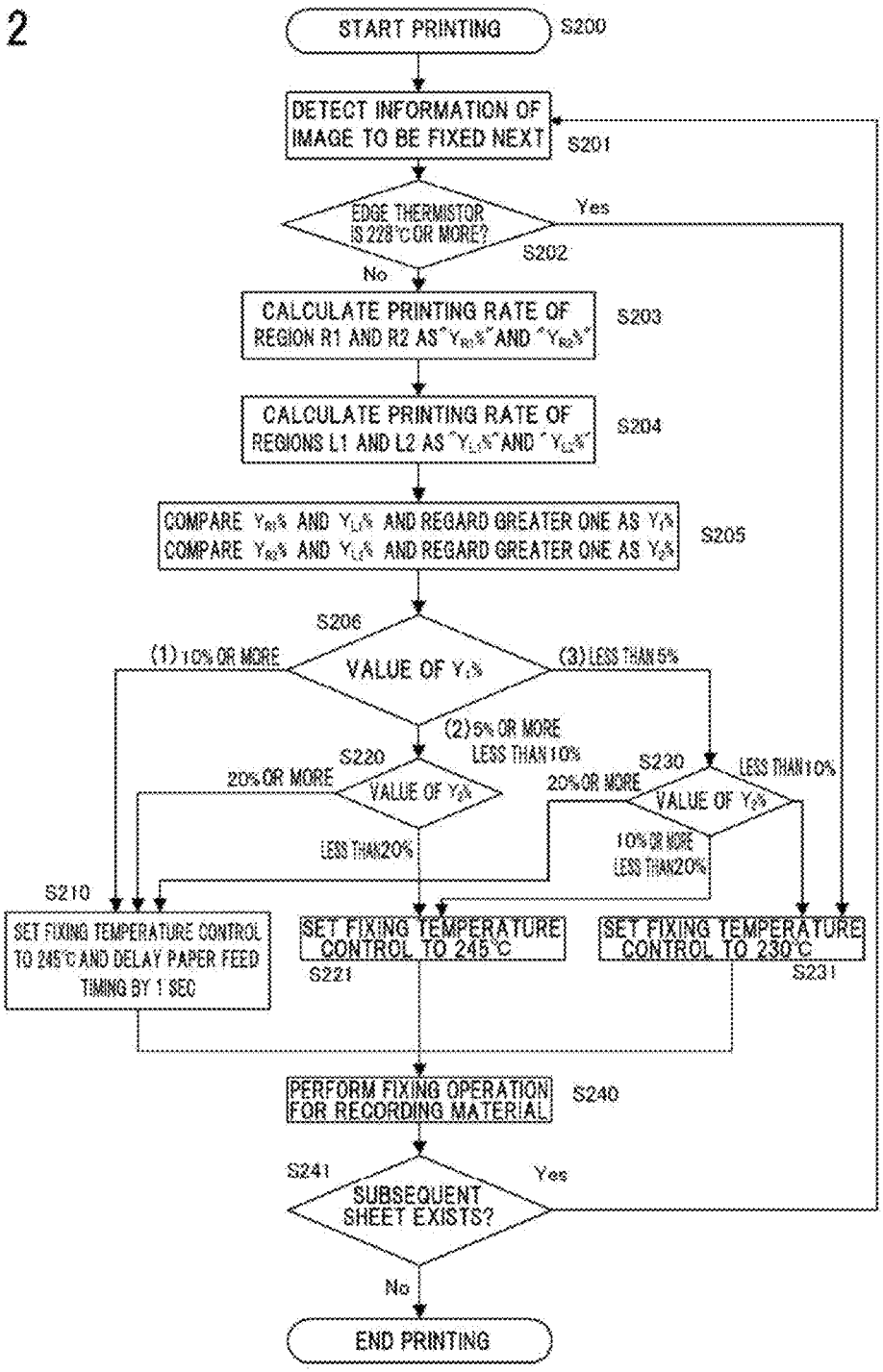
FIG. 12 is a flow chart depicting the sequence of the fixing control of Example 2.

Fixing control of this example will be described next. FIG. 11 is a diagram depicting the detection regions to detect information on the printing rate according to this example. FIG. 12 is a flow chart depicting the sequence of the fixing control of this example.

The difference of the detection region of this example from Example 1 is that the detection regions in Example 1, that is regions R and L, are sub-divided into 2 mm wide vertically long regions respectively. In concrete terms, the printing rate detection regions of this example are four vertically long regions: a region (R1) located 2 to 4 mm from the right edge of the A4-sized sheet, a region (R2) located 4 to 6 mm from the right edge, a region (L1) located 2 to 4 mm from the left edge, and a region (L2) located 4 to 6 mm from the left.

By sub-dividing the printing rate detection regions like this, the generation of a fixing failure can be controlled even if the end portion temperature drop is more conspicuous.

Now the sequence of this example will be described with reference to FIG. 12. In this example, this sequence is performed for all print jobs. In this example, temperature at the end portion of the heater 20, detected by the end portion thermistor 208, is used to estimate the temperature rising state of the end portion of the fixing film 25.

As shown in FIG. 12, after the printing of the first sheet starts, image information is detected before starting the fixing operation (S201). Then in order to estimate the temperature on the end portion on the surface of the fixing film 25, the temperature of the end portion of the heater 20 is detected by the end portion thermistor 208 (S202). If the detected temperature by the end portion thermistor 208 is 228° C. or more, it is estimated that the end portion temperature drop is small, the target control temperature is set to 230° C. (S231), and the fixing operation is executed (S240). If the detected temperature of the end portion thermistor 208 is less than 228° C., on the other hand, it is estimated that the end portion temperature drop is large, and control to change the fixation temperature in accordance with the information on the printing rate is started.

Then according to the image information detected in S201, the printing rates of the regions $R_1$ and $R_2$ shown in FIG. 11 are calculated, and the results are regarded as "$Y_{R1}$%" and "$Y_{R2}$%" respectively (S203). In the same manner, the printing rates of the regions $L_1$ and $L_2$ are calculated, and the results are regarded as "$Y_{L1}$%" and "$Y_{L2}$%" respectively (S204). Then the acquired $Y_{R1}$% and $Y_{L1}$% are compared, and the greater one is regarded as "$Y_1$%". Also $Y_{R2}$% and $Y_{L2}$% are compared, and the greater one is regarded as "$Y_2$%" (S205).

Then $Y_1$% acquired in S205 is compared with printing rates 5% and 10% (S206). If $Y_1$% is 10% or more in S206 (1), the target control temperature is set to 240° C., and the paper feed timing is delayed by 1 sec (S210). If $Y_1$% is 5% or more and less than 10% in S206 (2), then $Y_2$% is compared with 20% (S220). If $Y_2$% is 20% or more in S220, the target control temperature is set to 240° C., and the paper feed timing is delayed by 1 sec (S210). If $Y_2$% is less than 20% in S220, the target control temperature is set to 240° C. (S221). If $Y_1$% is less than 5% in S206 (3), $Y_2$% is compared with 10% and 20% (S230). If $Y_2$% is 20% or more in S230, the target control temperature is set to 240° C., and the paper feed timing is delayed by 1 sec (S210). If $Y_2$% is 10% or more and less than 20% in S230, the target control temperature is set to 240° C. (S221). If $Y_2$% is less than 10% in S230, the target control temperature is set to 230° C. (S231). Once the target control temperature is set this way, the fixing operation is executed (S240), and the operation in S201 to S204 is repeated as long as an unprocessed print job remains (S241).

By performing the above sequence, this example can implement an effect similar to Example 1 described above.

In this example, a threshold of the printing rate is set for each of the sub-divided detection regions, but the present invention is not limited to this. By sub-dividing a detection region, the generation of a fixing failure can be controlled even in the case when the end portion temperature drop is more conspicuous, and the threshold of the printing rate for each detection region may be set to any appropriate value. The above mentioned fixing control may be executed when there is at least one region where the printing ratio detected for each of the sub-divided detection regions is the predetermined threshold or more. Further, in this example, the regions R and L in Example 1 are sub-divided into two respectively, but the present invention is not limited to this. In other words, it is sufficient if the regions R and L are divided into a plurality of regions in the longitudinal direction, and the threshold of printing ratio is set for each region respectively.

Example 3

Example 3 will now be described. The differences of Example 3 from Example 1 are only in the configuration of the fixing apparatus and the sequence of the fixing control using the information on the printing rate. In this example, only the composing elements that differ from Example 1 will be described, and description of the same composing elements as Example 1 is omitted.

Figure 13:
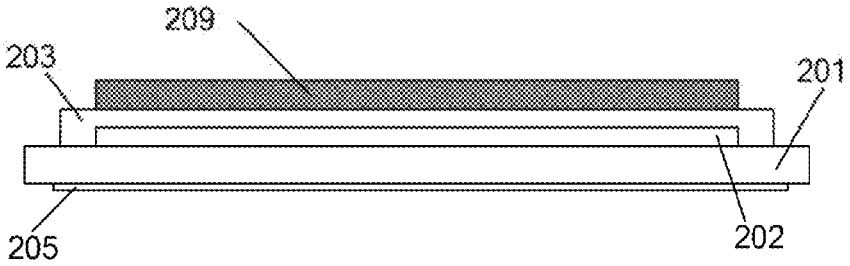
FIG. 13 is a cross-sectional view depicting a heater of Example 3.

FIG. 13 is a cross-sectional view depicting a general configuration of a heater 20 of this example. The configuration of this example is suitable for an image forming apparatus of which longitudinal thermal conductivity of the heater 20 is enhanced, whereby the temperature rising in the non-paper passing portions is decreased.

(Configuration of Fixing Apparatus)

The configuration of the fixing apparatus C of this example will be described with reference to FIG. 13. A high thermal conductivity plate 209, as the high thermal conductivity member, is contacted to the heater 20 of this example, so as to improve the thermal conductivity in the longitudinal direction. By this high thermal conductivity plate 209, the thermal conductivity of the heater 20 in the longitudinal direction increases, which is advantageous to suppress temperature rising in the non-paper passing portions. In this example, a 2 mm thick aluminum plate is used for the high thermal conductivity plate 209, and the width thereof in the longitudinal direction is 216 mm, which is the same as the heating element. The material of the high thermal conductivity plate 209 may be sheet type graphite, for example.

If the thermal conductivity of the heater 20 in the longitudinal direction is increased like this, however, an end portion fixing failure may occur on a first sheet to be printed at a cold start, which becomes a concern. Generally the temperature of the end portions of the heater substrate 201 is lower at a cold start (e.g. temperature of the heater 20 is less than 50° C.), compared with the case of a hot start. As a result, the heat of the heating element pattern 202 flows to the end portions of the heater substrate 201 in the longitudinal direction at startup, the end portion temperature drop is generated and a fixing failure occurs due to insufficient heat in the end portions of the recording material P, which becomes a concern. In the case of a hot start, on the other hand, the temperature on the end portions of the heater substrate 201 is already high, hence heat does not flow to the end portions and the end portion temperature drop is not easily generated.

Thus in the fixing apparatus having the above configuration, the end portion temperature drop is particularly conspicuous at a cold start, compared with a hot start, and a fixing failure easily occurs to the end portion, which becomes a concern. Therefore the following fixing control is executed in this example.

(Fixing Control)

Figure 14:
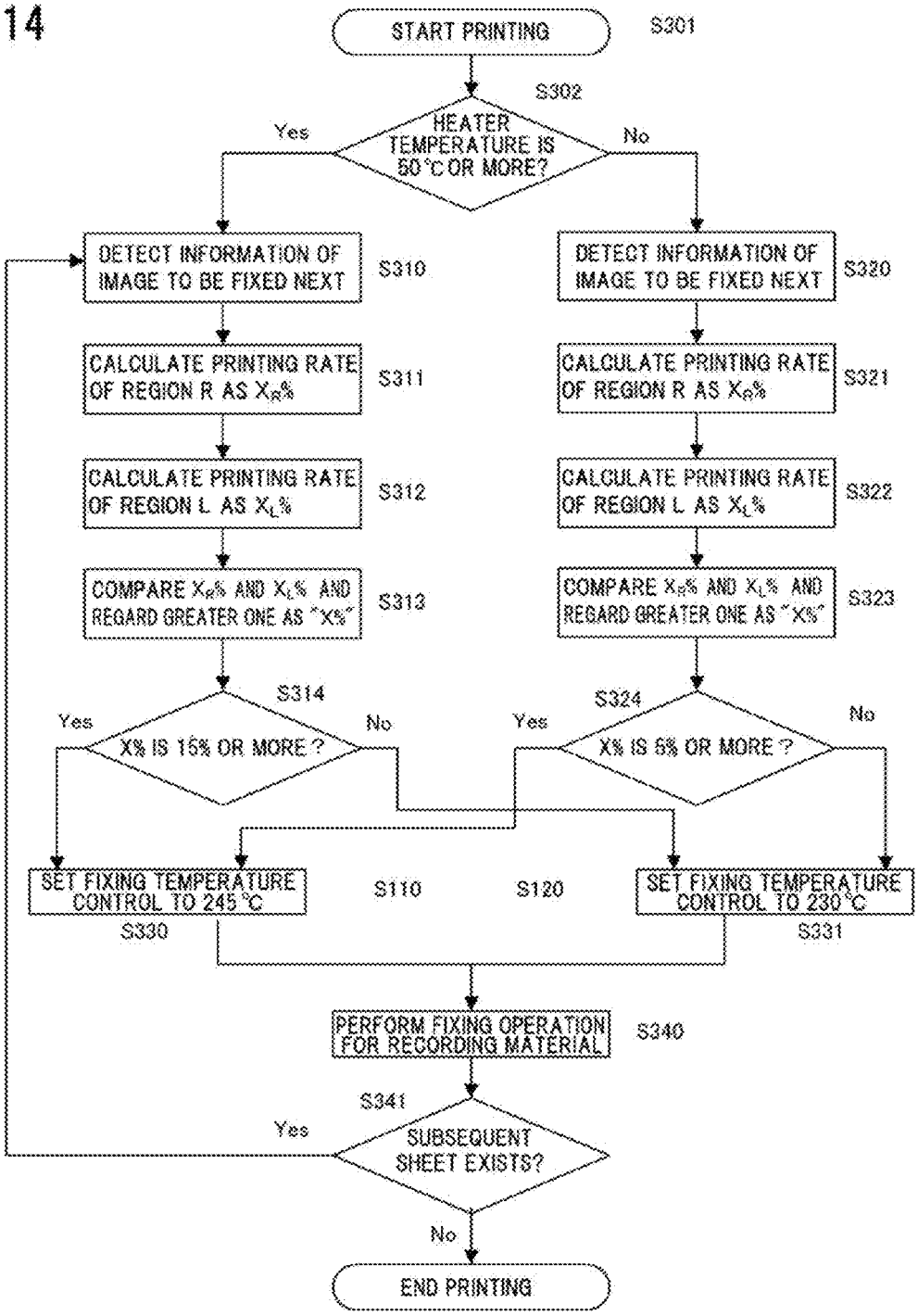
FIG. 14 is a flow chart depicting the fixing control of Example 3.

FIG. 14 is a flow chart depicting the sequence of the fixing control of this example.

The characteristic of the sequence of this example is that a cold start/hot start is determined when printing is started, and the threshold of the end portion printing rate, to increase the target control temperature of fixing, is changed depending on the result. Thereby the generation of a fixing failure can be prevented even at a cold start where the end portion temperature drop is conspicuous. The detection regions where information on the printing rate is detected are the same as Example 1, and redundant description is omitted here.

As shown in FIG. 14, after the printing of the first sheet is started (S301), the temperature of the heater 20 is detected and compared with 50° C. temperature (S302). If the detected temperature is 50° C. or more (hot start), the printing rate information on both end portions is detected in the same manner as Example 1, and the greater one is regarded as X%, and is used as information on the printing rate for the subsequent sheet (S310 to S313). Then X% is compared with 15% [printing rate] (S314), and if X% is greater than 15%, the target control temperature is set to 240° C. (S330), and if smaller than 15%, the fixation temperature is set to 230° C. (S331).

In the case when the temperature detection result by the heater 20 at the start of printing is less than 50° C. (cold start) will be described. In this case as well, the printing rate information on both end portions is detected, and the greater one is regarded as X% and is used as information on the printing rate for the subsequent sheet (S320 to S323). Then X % is compared with 5% [printing rate] (S324), and if X% is greater than 5%, the target control temperature is set to 240° C. (S330), and if smaller than 5%, the fixation temperature is set to 230° C. (S331). Then the fixing operation for the recording material P is performed at the target control temperature which was set in S330 or S331 (S340). Then the operation at hot start, which is the operation in S310 to S340, is repeated as long as an unprocessed print job remains (S341).

By performing the above sequence, an effect similar to Example 1 described above can be implemented, even in an image forming apparatus as in this example, in which the end portion temperature drop is conspicuous at a cold start.

In the fixing control of this example, the temperature of the heater 20 is detected in S302, but the present invention is not limited to this. In other words, it is sufficient if a cold start/hot start can be determined in S302, and the temperature of the fixing film 25 or the temperature of the fixing apparatus C may be detected.

In this example, when the temperature of the heater 20 is less than 50° C. in S302, the threshold of the printing rate is set to be smaller for the first sheet of the recording material P when printing starts, compared with the case when the temperature is 50° C. or more, but the present invention is not limited to this. In other words, S302 may be executed for a predetermined number of sheets of recording material P, for which the generation of an end portion temperature dorp is concerned, from the beginning of printing, and the threshold of the printing rate may be set to be smaller when the temperature of the heater 20 is less than 50° C., compared with the case when the temperature is 50° C. or more. This predetermined number of sheets may be set to an appropriate set value in accordance with the specification of the fixing apparatus, the environment where the image forming apparatus is installed, or the like.

Example 4

Embodiment 4 will now be described. An image forming apparatus of this example is characterized in that the maximum size width of the recording material P that can be fed is LTR/LGL sizes (width: 8.5 inches≈215.9 mm). Therefore the only difference between this example and Example 1 is that the detection regions where the end portion printing rate is detected and the conditions that enhance the fixing temperature control are changed for each size of the recording material. Hence only the composing elements that are different from Example 1 will be described, and description on the same composing elements as Example 1 is omitted.

Figure 15:
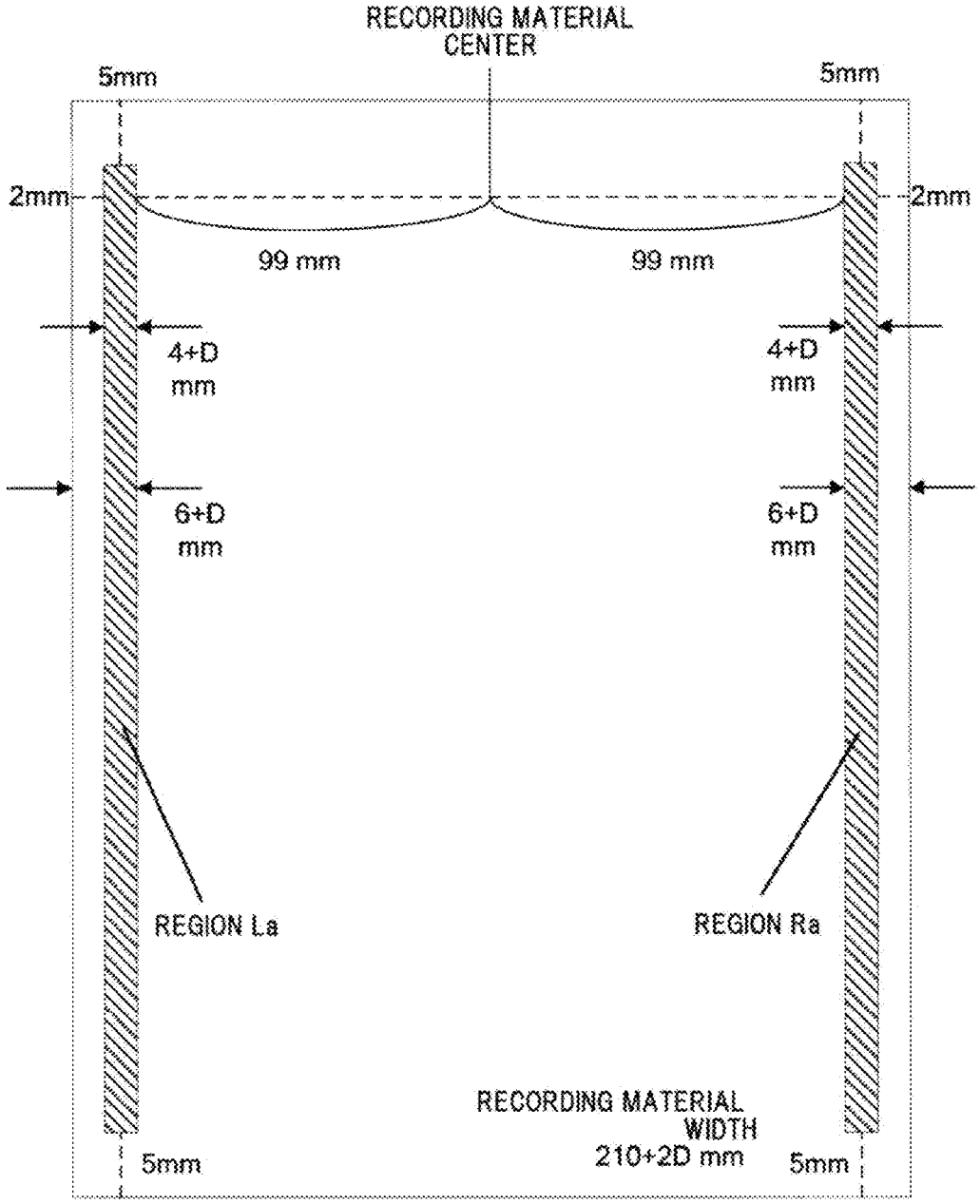
FIG. 15 is a diagram depicting regions to detect the printing rate information of Example 4.

FIG. 15 is a diagram depicting the detection regions to acquire information on the printing rate of this example. In the image forming apparatus of this example, the end portion printing rate detection regions are "Region Ra" and "Region La" shown in FIG. 15. The regions Ra and La are different depending on the size of the recording material, which is the characteristic of this example. If the width of the recording material P is 210+2D mm as shown in FIG. 15, the region Ra becomes a vertically long region (width 4+D mm), 2 mm to 6+D mm from the right edge of the recording material, and the region La becomes a vertically long region (width 4+D mm), 2 mm to 6+D mm from the left edge of the recording material. For example, in the case of A4 size, D=0, and the region Ra becomes 2 mm to 6 mm from the right edge, and the region La becomes 2 mm to 6 mm from the left edge, which match with the regions R and L of Example 1. In the case of the LTR/LGL sizes, D≈2.95 mm, and the region Ra becomes 2 mm to 8.95 mm from the right edge, and the region La becomes 2 mm to 8.95 mm from the left edge.

In this example, the threshold to enhance the target control temperature in accordance with the information on the printing rate is changed for each size of the recording material. In Example 1, the target control temperature is set to 240° C. if the end portion printing rate is 15% or more, but in this example, the target control temperature is set to 240° C. if the end portion overage rate is "15−2D (%)" or more. For example, the end portion printing rate is 15% or more in the case of the A4 size, and 9.1% or more in the case of the LTR/LGL sizes. Thus in this example, the threshold is set in the longitudinal direction as follows. The larger width is set for the end portion printing rate detection region when the size of the recording material P is large, compared with the case when the size of the recording material P is small. Moreover, the threshold of the printing rate, to enhance the target control temperature, is set small when the size of the recording material P is large, compared with the case when the size of the recording material P is small. Here in the longitudinal direction, the width of the end portion printing rate detection region may be increased as the size of the recording material P is larger, and the threshold of the printing rate, to enhance the target control temperature, may be decreased as the size of the recording material P is larger.

As described above, the present invention can be applied ideally even to an image forming apparatus that prints various sizes of the printing material P, by changing the end portion printing rate detection regions and the conditions to change the fixation temperature in accordance with the size of the recording material P. Thereby an effect similar to Example 1 described above can be implemented.

Each example described above can be combined whenever possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-069483, filed Mar. 28, 2014 which is hereby incorporated by reference herein in its entirety.

What is claimed is:

1. An image forming apparatus that forms a toner image on a recording material, comprising:

an image forming unit that forms the toner image on the recording material;

a fixing unit that fixes the toner image on the recording material while conveying the recording material bearing the toner image at a nip portion, the fixing unit including a heating member and a backup member forming the nip portion together with the heating member;

a temperature detection portion that detects a temperature on the heating member;

a controller that controls power to be supplied to the heating member so that the temperature detected by the temperature detection portion becomes a target temperature; and an acquisition portion that acquires information related to a ratio of an area of the toner image in a predetermined region to an area of the predetermined region, the predetermined region being located in a 2 to 6 mm range from an edge of the recording material in a width direction of the recording material and having a predetermined length in a conveyance direction of the recording material, wherein the controller changes the target temperature in accordance with the ratio.

2. The apparatus according to claim 1, wherein the predetermined region is different, depending on the size of the recording material.

3. The apparatus according to claim 1, wherein the controller changes the target temperature in accordance with the ratio only in a period when the number of continuously printed sheets is less than the predetermined number.

4. The apparatus according to claim 1, wherein the acquisition portion acquires the ratio for a first region which is located in one end portion of the recording material in the width direction, and for a second region which is located in the other end portion, wherein the controller changes the target temperature in accordance with the greater of the ratio for the first region and the ratio for the second region.

5. The apparatus according to claim 1, wherein the controller sets the target temperature to be higher in the case when the ratio is greater than a threshold, compared with the case when the ratio is smaller than the threshold.

6. The apparatus according to claim 1, wherein the heating member includes a cylindrical film.

7. The apparatus according to claim 1, wherein the controller is configured such that a heat generation distribution of the heating member, in a width direction of the recording material, is unchangeable.

8. The apparatus according to claim 1, wherein the predetermined length is a longer than a width of the predetermined region in the width direction.

9. An image forming apparatus that forms a toner image on a recording material, comprising:

an image forming unit that forms the toner image on the recording material;

a fixing unit that fixes the toner image on the recording material while conveying the recording material bearing the toner image at a nip portion, the fixing unit including a heating member and a backup member forming the nip portion together with the heating member;

a temperature detection portion that detects a temperature on the heating member;

a controller that controls power to be supplied to the heating member, so that the temperature detected by the temperature detection portion becomes a target temperature; and an acquisition portion that acquires information related to a ratio of an area of the toner image in a predetermined region to an area of the predetermined region, the predetermined region being located in a predetermined range form an edge of the recording material in a width direction of the recording material and having a predetermined length in a conveying direction of the recording material, the predetermined region being located closer to the edge of the recording material than a center of the recording material in the width direction of the recording material, wherein the controller changes an interval between a preceding recording material and a subsequent recording material in accordance with the ratio when continuous printing is performed.

10. The apparatus according to claim 9, wherein the predetermined region is different, depending on the size of the recording material.

11. The apparatus according to claim 9, wherein the predetermined range is 2 to 6 mm range from the edge of the recording material in the width direction.

12. The apparatus according to claim 9, wherein the controller changes the interval in accordance with the ratio, only in a period when the number of continuously printed sheets is less than a predetermined number.

13. The apparatus according to claim 9, wherein the acquisition portion acquires the ratio for a first region which is located in one end portion of the recording material in the width direction, and for a second region which is located in the other end portion, wherein the controller changes the interval in accordance with the greater of the ratio of the first region and the ratio of the second region.

14. The apparatus according to claim 9, wherein the controller sets the interval to be larger in the case when the ratio is greater than a threshold, compared with the case when the ratio is smaller than the threshold.

15. The apparatus according to claim 9, wherein the heating member includes a cylindrical film.

16. The apparatus according to claim 9, wherein the controller is configured such that a heat generation distribution of the heating member, in a width direction of the recording material, is unchangeable.

17. The apparatus according to claim 9, wherein the predetermined length is a longer than a width of the predetermined region in the width direction.

18. An image forming apparatus that forms a toner image on a recording material, comprising:

an image forming unit that forms the toner image on the recording material;

a fixing unit that fixes the toner image on the recording material while conveying the recording material bearing the toner image at a nip portion, the fixing unit including a heating rotation member and a backup member forming the nip portion together with the heating rotation member;

a temperature detection portion that detects a temperature of the heating rotation member;

a controller that controls power to be supplied to the heater so that the temperature detected by the temperature detection portion becomes a target temperature, the controller being configured such that a heat generation distribution of the heating rotation member, in a width direction of the recording material, is unchangeable, and an acquisition portion that acquires information related to a ratio of an area of the toner image in a predetermined region to an area of the predetermined region, the predetermined region being located in a predetermined range from an edge of the recording material in a width direction of the recording material and having a predetermined length in a conveyance direction of the recording material, the predetermined region being located closer to the edge of the recording material than a center of the recording material in the width direction of the recording material, wherein the controller changes the target temperature in accordance with the ratio.

19. The apparatus according to claim 18, wherein the predetermined length is a longer than a width of the predetermined region in the width direction.

* * * * *